US009183981B2

(12) United States Patent
Ueno et al.

(10) Patent No.: US 9,183,981 B2
(45) Date of Patent: Nov. 10, 2015

(54) REACTOR AND MANUFACTURING METHOD THEREOF

(75) Inventors: Yasuhiro Ueno, Toyota (JP); Fumio Nomizo, Toyota (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 13/394,677

(22) PCT Filed: Jun. 27, 2011

(86) PCT No.: PCT/JP2011/064691

§ 371 (c)(1),
(2), (4) Date: Mar. 7, 2012

(87) PCT Pub. No.: WO2013/001593

PCT Pub. Date: Jan. 3, 2013

(65) Prior Publication Data

US 2014/0218152 A1 Aug. 7, 2014

(51) Int. Cl.
*H01F 27/30* (2006.01)
*H01F 17/04* (2006.01)
(Continued)

(52) U.S. Cl.
CPC ..... *H01F 27/341* (2013.01); *H01F 3/14* (2013.01); *H01F 27/022* (2013.01); *H01F 37/00* (2013.01); *H01F 41/005* (2013.01); *H01F 41/125* (2013.01); *Y10T 29/4902* (2015.01)

(58) Field of Classification Search
CPC ..... H01F 27/306; H01F 3/14; H01F 27/06; H01F 27/263; H01F 2017/048; H01F 27/022
USPC ..... 336/165, 196, 198, 212, 216, 221; 29/602.1
See application file for complete search history.

(56) References Cited

U.S. PATENT DOCUMENTS 2,911,604 A * 11/1959 Krause ..... 336/90
4,311,978 A * 1/1982 Crockett et al. ..... 336/92
(Continued)

FOREIGN PATENT DOCUMENTS

CN 101689420 A 3/2010
EP 2315220 A1 4/2011
(Continued)

OTHER PUBLICATIONS

International Search Report of PCT/JP2011/064691, dated Aug. 16, 2011.
(Continued)

*Primary Examiner* — Alexander Talpalatski
*Assistant Examiner* — Joselito Baisa
(74) *Attorney, Agent, or Firm* — Sughrue Mion, PLLC

(57) ABSTRACT

A reactor comprises a reactor core in which two U-shaped core members are connected in a ring shape with a gap section therebetween, a primary insert-molded resin part provided covering at least an outer peripheral surface of a leg part of the core member other than an adhesion surface of the core member, a coil placed around the gap section and the leg part of the core member, and a secondary insert-molded resin part made of a thermoplastic resin and which is insert-molded around the coil to fix the coil on the reactor core and fix the leg parts of the core members in a connected state. A positioning section which determines a relative position of opposing leg parts and a window section which allows a melted thermoplastic resin for forming the secondary insert-molded resin part to flow into the gap section are formed on an end of the primary insert-molded resin part connected in a state where core members are placed connected in a ring shape.

10 Claims, 7 Drawing Sheets

(51) Int. Cl.

| | |
|---|---|
| ***H01F 27/24*** | (2006.01) |
| ***H01F 27/34*** | (2006.01) |
| ***H01F 37/00*** | (2006.01) |
| ***H01F 3/14*** | (2006.01) |
| ***H01F 27/02*** | (2006.01) |
| ***H01F 41/12*** | (2006.01) |
| ***H01F 41/00*** | (2006.01) |

(56) References Cited

U.S. PATENT DOCUMENTS

| | | | | |
|---|---|---|---|---|
| 4,891,620 | A * | 1/1990 | Cheng | 336/198 |
| 5,210,514 | A * | 5/1993 | Ito et al. | 336/178 |
| 5,719,544 | A * | 2/1998 | Vinciarelli et al. | 336/84 C |
| 5,977,855 | A * | 11/1999 | Matsumura et al. | 336/96 |
| 6,143,157 | A * | 11/2000 | Andrus et al. | 205/205 |
| 8,049,590 | B2 * | 11/2011 | Huh et al. | 336/208 |
| 8,279,035 | B2 * | 10/2012 | Yoshikawa et al. | 336/96 |
| 8,749,335 | B2 | 6/2014 | Ueno et al. | |
| 2002/0014941 | A1 * | 2/2002 | Yoshioka et al. | 336/184 |
| 2009/0108971 | A1 * | 4/2009 | Okamoto | 336/65 |
| 2010/0209314 | A1 | 8/2010 | Sato | |
| 2011/0156853 | A1 * | 6/2011 | Kato et al. | 336/192 |
| 2014/0012440 | A1 | 1/2014 | Inoue | |
| 2014/0125440 | A1 | 5/2014 | Ueno et al. | |

FOREIGN PATENT DOCUMENTS

| | | | |
|---|---|---|---|
| JP | 62-219607 | A | 9/1987 |
| JP | 08-181022 | A | 7/1996 |
| JP | 11-345715 | A | 12/1999 |
| JP | 2007134513 | A * | 5/2007 |
| JP | 2007-180140 | A | 7/2007 |
| JP | 2009-027000 | | 2/2009 |
| JP | 2009-32922 | A | 2/2009 |
| JP | 2009-99793 | A | 5/2009 |
| JP | 2009-259986 | A | 11/2009 |
| JP | 2010-103307 | | 5/2010 |
| JP | 2010-171209 | | 8/2010 |
| JP | 2010226138 | A | 10/2010 |
| JP | 2011-029336 | | 2/2011 |
| JP | 2011-86801 | A | 4/2011 |
| JP | 5626466 | | 11/2014 |
| WO | 2013/001591 | | 1/2013 |

OTHER PUBLICATIONS

Notice of Allowance dated Jan. 22, 2014, issued by the U.S. Patent and Trademark Office in U.S. Appl. No. 13/813,598.(patented as U.S. Pat. No. 8,749,335).

Non-Final Office Action dated Oct. 16, 2014, issued by the U.S. Patent and Trademark Office in U.S. Appl. No. 14/129,176. (Published as US 2014/0012440).

Notice of Allowance dated Jan. 22, 2014, issued by the U.S. Patent and Trademark Office in U.S. Appl. No. 13/813,598.

Office Action dated Oct. 16, 2014, issued by the U.S. Patent and Trademark Office in U.S. Appl. No. 14/129,176.

Communication dated May 13, 2015 from the United States Patent and Trademark Office in counterpart U.S. Appl. No. 14/129,176.

Communication dated Mar. 17, 2015 from the United States Patent and Trademark Office in counterpart U.S. Appl. No. 14/129,176.

Communication dated Aug. 27, 2015 from the United States Patent and Trademark Office in counterpart U.S. Appl. No. 14/129,176.

* cited by examiner

REACTOR AND MANUFACTURING METHOD THEREOF

CROSS REFERENCE TO RELATED APPLICATIONS

This application is a National Stage of International Application No. PCT/JP2011/064691 filed Jun. 27, 2011, the contents of all of which are incorporated herein by reference in their entirety.

TECHNICAL FIELD

The present invention relates to a reactor and a manufacturing method thereof, and in particular to a reactor which is equipped in an electric vehicle, a hybrid electric vehicle, or the like and a manufacturing method thereof.

BACKGROUND ART

Conventionally, there exists a structure in which a reactor is incorporated into apart of an electric power conversion circuit equipped on an electrically driven vehicle such as a hybrid electric vehicle. This reactor is used, for example, for a converter or the like which boosts a voltage of direct current electrical power supplied from a battery and outputs the resulting electrical power to the side of a motor which is a source of motive force.

In general, a reactor comprises a plurality of core members made of magnetic materials, a reactor core formed by connecting the core members in a ring shape with a non-magnetic gap plate therebetween, and a coil placed around a coil attachment position of the reactor core including the gap plate. The reactor including the reactor core and the coil is equipped on a vehicle, for example, in a state where the reactor is fixed using a bolt or the like in a casing made of a metal such as aluminum alloy.

As a related art document related to the above-described reactor, JP 2009-99793 A (Patent Literature 1) discloses a method of manufacturing a reactor in which a reactor core having a coil is stored and fixed in a housing, and a silicone resin is impregnated and cured between the housing, reactor core, and coil, to fix the reactor in the housing.

JP 2009-32922 A (Patent Literature 2) discloses a reactor core having a plurality of magnetic core members and non-magnetic gap plates interposed between adjacent core members, wherein an opposing surface of the core member and an opposing surface of the gap plate are fixed via an adhesive layer, and a pulling transmission device of leaking magnetic flux is formed on a peripheral surface other than the opposing surface of the gap plate, for puling the leaking magnetic flux leaking from the core member and applying the leaking magnetic flux to the adjacent core member.

RELATED ART REFERENCES

Patent Literature

[Patent Literature 1] JP 2009-99793 A
[Patent Literature 2] JP 2009-32922 A

SUMMARY OF INVENTION

Technical Problem

In the reactors of the above-described Patent Literature 1 and 2, the reactor core of a ring shape is formed by adhering and fixing the core members by an adhesive and with non-magnetic gap plates therebetween. When a thermosetting adhesive is used as the adhesive, the curing process would require a long period of time, and a large number of jigs have been required for maintaining the reactor core, that has been assembled in the ring shape, in the pressurized state until the adhesive is cured.

In addition, for the non-magnetic gap plate made of, for example, a ceramic plate, the thickness must be highly precisely controlled in order to accurately define a gap size which significantly affects the reactor performance, which results in an increase in the manufacturing cost, an increase in the number of components forming the reactor, and an increase in complexity of the assembling process.

An advantage of the present invention is that a reactor and a manufacturing method thereof are provided in which the reactor maintaining jig, a heating furnace, and the gap plate are made unnecessary, and the reactor can be easily manufactured in a short time.

Solution to Problem

According to one aspect of the present invention, there is provided a reactor comprising a reactor core in which two U-shaped core members are connected in a ring shape with a gap section therebetween, a primary insert-molded resin part which is provided covering at least an outer periphery surface of a leg part of the core member other than an adhesion surface of the core member, a coil which is placed around the gap section and the leg part of the core member, and a secondary insert-molded resin part which is made of a thermoplastic resin and which is insert-molded around the coil to fix the coil on the reactor core and fix the leg parts of the two core members in a connected state, wherein a positioning section which determines a relative position of opposing leg parts and a window section which allows a melted thermoplastic resin for forming the secondary insert-molded resin part to flow into the gap section are formed on ends of the primary insert-molded resin part connected to each other in a state in which the core members are placed connected in a ring shape.

According to another aspect of the present invention, preferably, in the reactor, a flow path for guiding the melted thermoplastic resin to the window section on an inner peripheral side of the coil is formed on a surface of the primary insert-molded resin part.

According to another aspect of the present invention, preferably, in the reactor, an end, on a side opposite to the window section, of a channel forming the flow path extends to outside of the coil.

According to another aspect of the present invention, preferably, in the reactor, a gas draining passage is formed on an end to be connected of the primary insert-molded resin part According to another aspect of the present invention, preferably, in the reactor, the gas draining passage is positioned at a downstream side in relation to a direction of flow and spreading of the melted thermoplastic resin flowing from the window section into the gap section.

According to another aspect of the present invention, preferably, in the reactor, the core member is made of a pressed powder core formed by pressure-molding magnetic powder, and the melted thermoplastic resin flowing into the gap section enters and is cured in a space between the magnetic powder forming an end surface of the leg part.

According to another aspect of the present invention, preferably, in the reactor, of two leg parts of one of the core members having the U-shape, the positioning section having a recess shape is formed on the primary insert-molded resin part of one of the leg parts, and the positioning section having a projected shape which is fitted with the recess-shaped positioning section is formed on the primary insert-molded resin part of the other leg part.

According to another aspect of the present invention, there is provided a method of manufacturing a reactor having a reactor core in which two U-shaped core members are connected in a ring shape with a gap section therebetween and a coil provided around the reactor core including the gap section, the method comprising preparing the two core members and the coil, insert-molding a thermoplastic resin for each of the core members, to form a primary insert-molded resin part covering at least an outer peripheral surface of the core member other than an end surface of a leg part, placing the core members connected in a ring shape in a state in which the leg parts of the core members are passed through the coil, so that the ends of the primary insert-molded resin parts are connected to form a gap section of a certain size between the opposing end surfaces of the leg parts and a window section in communication with the gap section, and insert-molding a thermoplastic resin around the coil to form a secondary insert-molded resin part which fixes the coil on the reactor core and fixes the leg parts of the two core members in a connected state, wherein a melted thermoplastic resin is allowed to flow through the window section into the gap section on an inner peripheral side of the coil to adhere the opposing end surfaces of the leg parts.

According to another aspect of the present invention, preferably, in the method of manufacturing a reactor, the melted thermoplastic resin flowing through the window section into the gap section is guided along a flow path formed on a surface of the primary insert-molded resin part to the inner peripheral side of the coil, and flows to the window section.

According to another aspect of the present invention, in the method of manufacturing a reactor, when the melted thermoplastic resin is allowed to flow through the window section into the gap section and fill the gap section, the melted thermoplastic resin is filled while air or gas is drained through a gas draining passage formed on an end of the primary insert-molded resin part.

Advantageous Effects of Invention

According to a reactor and a manufacturing method thereof of various aspects of the present invention, the relative position of opposing leg parts is determined by the positioning sections formed on the ends of the primary insert-molded resin part, and thus, the size of the gap section is defined at a certain size. In addition, the melted thermoplastic resin for insert-molding the secondary part flows from the window section to the gap section and is cured, so that the end surfaces of the leg parts of the core members are adhered and fixed to each other with the thermoplastic resin functioning as an adhesive. Therefore, the non-magnetic gap plate as in the related art becomes no longer necessary. Moreover, the reactor maintaining jig and heating and curing furnace when the thermosetting adhesive is used for adhering and fixing the core members also become unnecessary. Therefore, the reactor can be easily manufactured in a short time, and a significant reduction in cost can be achieved.

DESCRIPTION OF EMBODIMENTS

A preferred embodiment of the present invention (hereinafter referred to as "embodiment") will now be described in detail with reference to the attached drawings. In this description, the specific shapes, materials, numerical values, directions, etc., are merely exemplary for facilitating understanding of the present invention, and may be suitably changed according to usage, objective, specification, etc. In addition, when a plurality of embodiments and alternative configurations are included in the following description, it is conceived that characteristic portions of these embodiments and alternative configurations may be used in a suitable combination.

Figure 1:
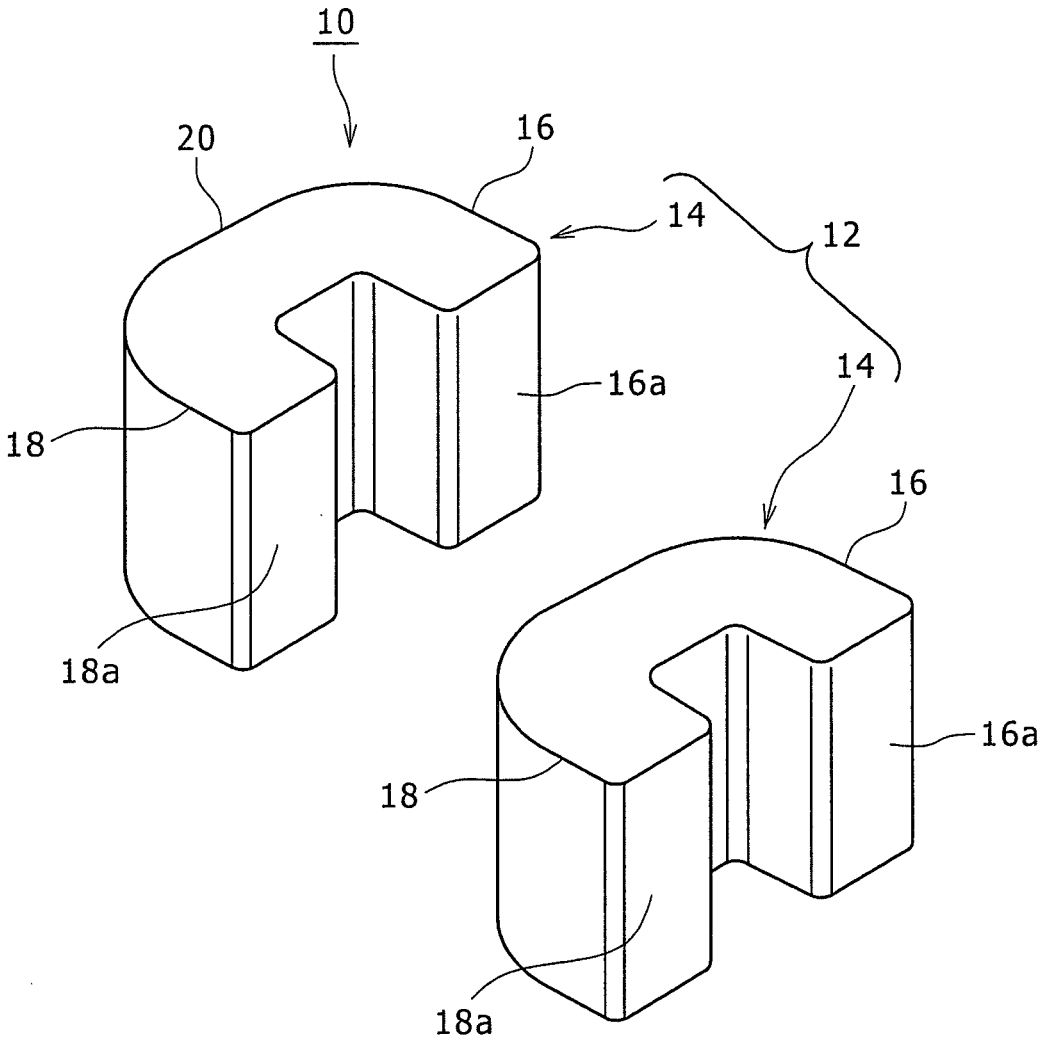
FIG. 1 is a perspective diagram showing a core member of a reactor core of a reactor according to a preferred embodiment of the present invention.

FIG. 1 is a perspective diagram showing a core member 14 of a reactor core 12 in a reactor 10 according to an embodiment of the present invention. The reactor core 12 in the present embodiment comprises two U-shaped core members 14 having the same shape.

The core member 14 comprises a first leg part 16 and a second leg part 18 which protrude parallel to each other, and a connecting section 20 connecting the leg parts 16 and 18 and having an approximate arc shape in a plan view. In addition, the core member 14 is preferably formed by a pressed powder core formed by mixing and pressure-molding a resin-coated magnetic powder and a binder. Alternatively, the core member 14 may be formed by a layered structure of steel plates in which a large number of electromagnetic steel plates stamped in approximate U-shapes are layered and integrally connected by calking or the like.

The first and second leg parts 16 and 18 of the core member 14 have rectangular end surfaces 16*a* and 18*a*, respectively. The end surfaces 16*a* and 18*a* become opposing surfaces and adhesion surfaces of the core members when two core members 14 are abutted in an approximate ring shape with the gap section therebetween.

Figure 2:
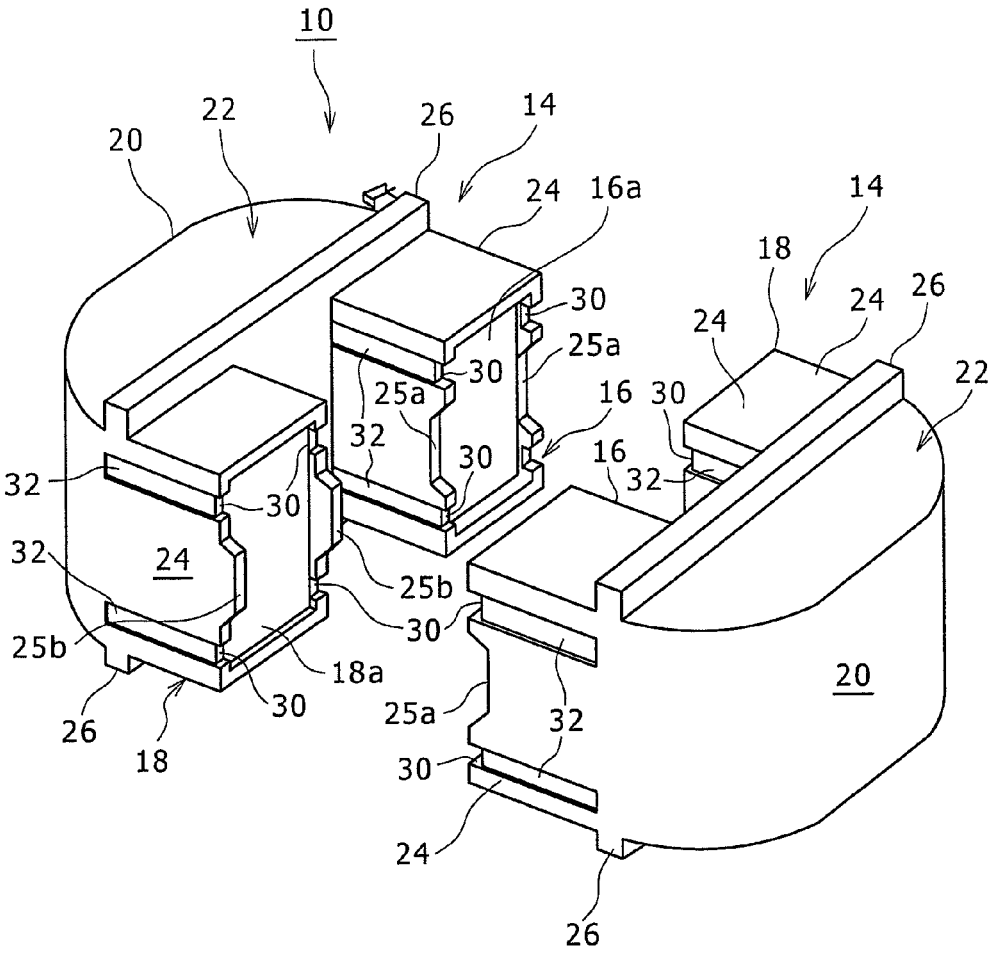
FIG. 2 is a perspective diagram showing a state in which a primary insert-molded resin part made of a thermoplastic resin is formed on the core member of FIG. 1.
Figure 3:
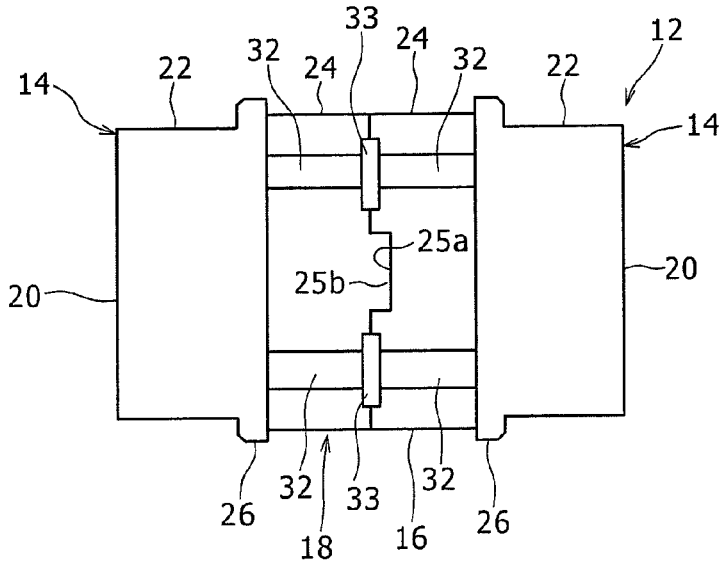
FIG. 3 is a side view showing a state where two core members, in which the primary insert-molded resin parts are formed, are connected in a ring shape.

FIG. 2 is a perspective diagram showing a state in which a primary insert-molded resin part 22 made of a thermoplastic resin is formed on the core member 14 of FIG. 1. FIG. 3 is a side view showing a state where two core members 14, in which the primary insert-molded resin parts 22 are formed, are connected in a ring shape.

As shown in FIG. 2, in the core member 14, the entirety of an outer peripheral surface other than the end surfaces 16*a* and 18*a* of the leg parts is covered by the primary insert-molded resin part 22. The primary insert-molded resin part 22 is formed by placing the core member 14 in a molding tool and injection-molding the thermoplastic resin. Here, as the thermoplastic resin, for example, polyphenylene sulfide (PPS) or the like is preferably used.

The primary insert-molded resin part 22 includes leg covering sections 24 covering the periphery around the leg parts 16 and 18. The leg covering sections 24 have a function to ensure an insulating distance between the coil and the reactor core 12 when the coil is placed around the leg parts 16 and 18, as will be described later.

The primary insert-molded resin part 22 includes wall sections 26 which protrude from upper and lower surfaces, respectively. The wall section 26 has a function to position the coil by approximately contacting the coil end surface when the coil is placed around the leg parts 16 and 18. Here, "approximate contact" means that a slight gap is formed to allow a melted thermoplastic resin for a secondary insert-resin molded part to flow into an inner peripheral side of the coil.

In addition, in the leg covering section 24 of the first leg part 16 in the primary insert-molded resin part 22, an end having a rectangular frame shape is formed protruding from the end surface 16*a* of the first leg part 16, and a recess (positioning section) 25*a* recessed in an approximate trapezoid shape is formed in each of two side sections of the protruded end opposed in the lateral direction. On the other hand, in the leg covering section 24 of the second leg part 18, an end having a rectangular frame shape is formed having approximately the same surface as, or protruding from, the end surface 18*a* of the second leg part 18, and a projection (positioning section) 25*b* protruding in an approximate trapezoid shape is formed in each of two side sections of the end opposed in the lateral direction.

The shapes of the positioning sections formed on the end of the primary insert-molded resin part 22 are not limited to the above-described shapes, and various shapes which fit each other in a projection-recess relationship may be employed. For example, the positioning section formed in the first leg part 16 may have a rectangular frame-shaped inner projection and the positioning section formed in the second leg part 18 may be formed in a rectangular frame-shaped outer projection including an inner recess to which the above-described inner projection can be fitted.

In the two core members 14 of the reactor core 12, the primary insert-molded resin parts 22 as described above are similarly formed. As shown in FIG. 2, a direction of one core member 14 is inverted so that the first leg part 16 and the second leg part 18 for two core members 14 are placed to oppose each other. With this configuration, when the two core members 14 are connected in a ring shape, the recess 25*a* formed in the leg covering section 24 of the first leg part 16 and the projection 25*b* formed in the leg covering section 24 of the second leg part 18 are fitted to each other, so that the relative position of the first leg part 16 and the second leg part 18 which oppose each other is determined. Therefore, a distance between the end surfaces 16*a* and 18*a* which oppose each other, that is, a size D of the gap section 17 (refer to FIG. 9), can be accurately defined.

In the core member 14 of the present embodiment, the recess 25*a* is formed in the first leg part 16 and the projection 25*b* is formed in the second leg part 18. With such a configuration, the primary insert-molded resin parts 22 of the same shape may be formed for the two core members 14 of the reactor core 12, and there is an advantage that only one type of molding tool for the primary insert-molding is required. However, the present invention is not limited to such a configuration, and alternatively, two types of molding tools may be used to form the recess 25*a* on two leg parts of one of the core members 14 and form the projection on the two leg parts of the other core member.

A cutout section 30 of a rectangular shape is formed on an end of the leg covering section 24 of the primary insert-molded resin part 22. In the present embodiment, a total of four cutout sections 30 are formed on positions on both sides of the recess 25*a* or the projection 25*b* and opposed in the lateral direction. With such a configuration, when the core members 14 are connected in a ring shape as shown in FIG. 3, the cutout sections 30 on both sides are combined, so that four rectangular window sections 33 are formed. These window sections 33 are in communication with the gap section 17 defined by a space formed between the end surfaces 16*a* and 18*b* of the leg parts, and are openings through which the melted thermoplastic resin is introduced into the gap section during secondary insert-molding.

In addition, a channel-shape flow path 32 having one end connected to the cutout section 30 is formed on a surface of the leg covering section 24 of the primary insert-molded resin part 22, in correspondence with each cutout section 30. The flow path 32 has a function to guide the melted thermoplastic resin to the inner peripheral side of the coil and to cause the melted thermoplastic resin to flow to the window section 33 during the secondary insert-molding. The other end of the flow path 32 formed on the outer surface of the primary insert-molded resin part 22 is preferably formed extending to the outside of the coil when the coil is assembled to the core member 14 (refer to FIG. 5). With such a configuration, it is possible to facilitate flow of the melted thermoplastic resin for the secondary insert-molding into the flow path 32.

In the primary insert-molded resin part 22, the recess and the projection as described above may also be formed on the two side sections opposed in the vertical direction on an end of the leg covering section 24 formed in a rectangular frame shape around the end surfaces 16*a* and 18*a* of the leg parts. With such a configuration, the relative position in the lateral direction can be reliably defined when the two core members 14 are combined.

In addition, because the primary insert-molded resin part 22 covers the entire outer periphery surface other than the end surfaces 16*a* and 18*a* of the leg parts, the primary insert-molded resin part 22 has a protection function to prevent damage to the core member 14 made of a pressed powder core having a relatively low hardness and which tends to be chipped, and also a function to ensure an insulating capability between the core member 14 and the metal casing when the reactor is attached on the metal casing, as will be described later.

Moreover, in the above, it is described that the size of the gap section is defined by the fitting of the recess 25*a* and the projection 25*b* which are formed in the ends of the primary insert-molded resin parts 22. Alternatively, the recess 25*a* and the projection 25*b* may have only the function to determine the position in the vertical direction of the two opposing leg parts 16 and 18, and the size D of the gap section 17 may be defined by contact of the leg covering section 24 of the primary insert-molded resin part 22 on portions other than the recess and the projection.

Figure 4:
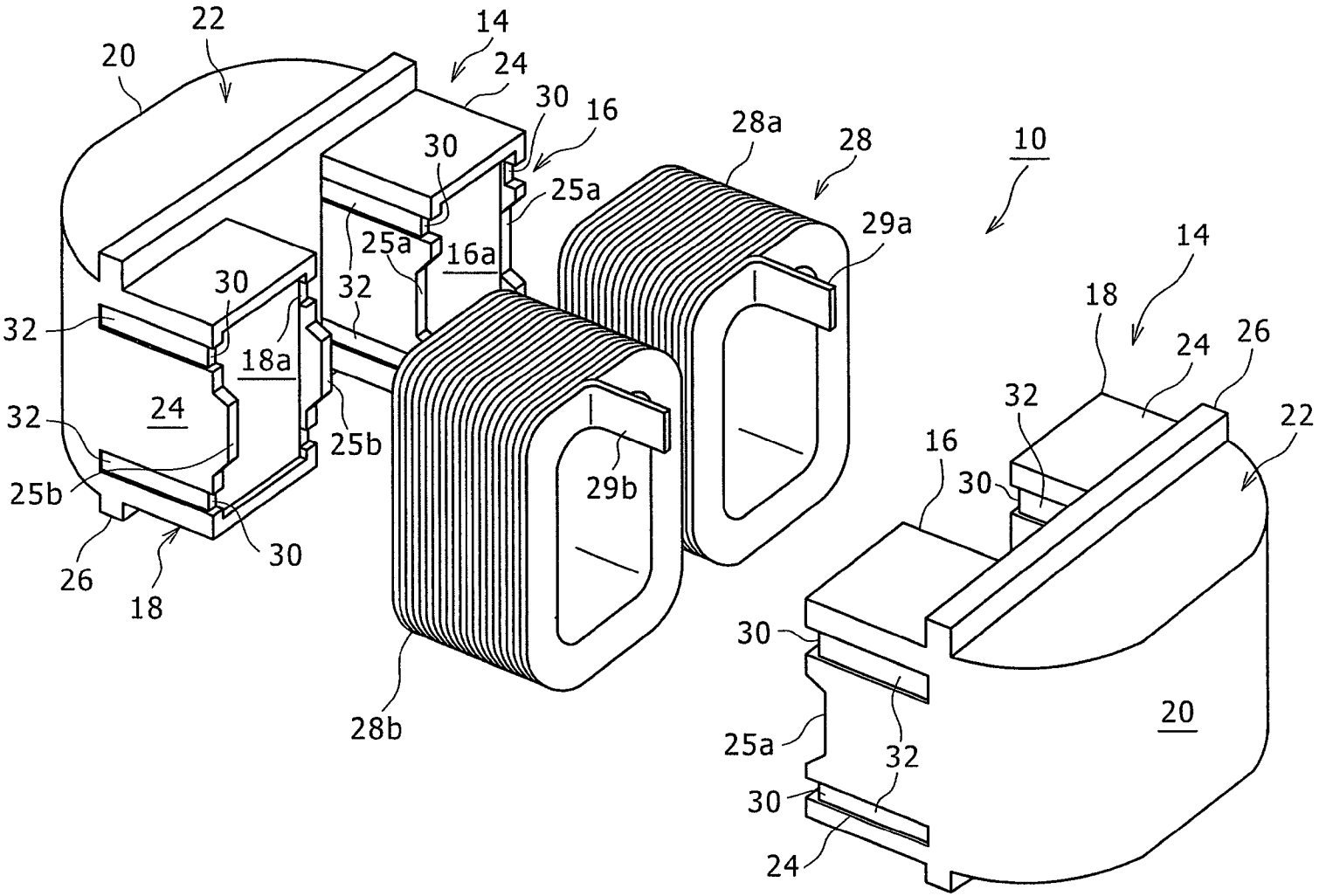
FIG. 4 is a pre-assembled perspective diagram showing two core members in which primary insert-molded resin parts are formed and a coil.

FIG. 4 is a pre-assembled perspective diagram showing the two core members 14 in which the primary insert-molded resin part 22 is formed, and a coil 28.

The coil 28 of the reactor 10 of the present embodiment is, for example, an edgewise type coil which is formed in advance by winding, around a former, a flat polygon conductor which is insulating coating processed with enamel or the like, and comprises two coil sections 28*a* and 28*b* which are connected in series. The coil sections 28*a* and 28*b* are formed by winding one continuous flat polygon conductor.

More specifically, when a conductor end 29*a* of one coil section 28*a* is the start of the winding, the flat polygon conductor is wound from the winding start in a counterclockwise direction to form the coil section 28*a*, the flat polygon conductor overpasses from the coil section 28*a* to the other coil section 28*b*, the flat polygon conductor is then wound in the clockwise direction to form the coil section 28*b*, and the flat polygon conductor is continued to a winding completion conductor end 29*b*. The conductor ends 29*a* and 29*b* protruding from the coil sections 28*a* and 28*b* in this manner are connected to electrical power input and output terminals for the coil 28 (that is, the reactor 10).

The coil sections 28*a* and 28*b* are formed in an inner peripheral shape of an approximate rectangular shape which is slightly larger than a leg covering section 24 formed on an outer periphery of the leg parts 16 and 18 of the core member 14. With this configuration, it becomes possible to pass the leg parts 16 and 18 of the core members 14 through the inside of the coil sections 28*a* and 28*b*. In addition, the lengths of the coil sections 28*a* and 28*b* in the winding direction are formed to be slightly shorter than a distance between the wall sections 26 of the primary insert-molded resin parts 22 of the two core members 14 connected in a ring shape. With this configuration, when the reactor core 12 is assembled, the coil sections 28*a* and 28*b* can be positioned with a slight clearance in the area between the two wall sections 26.

Figure 5:
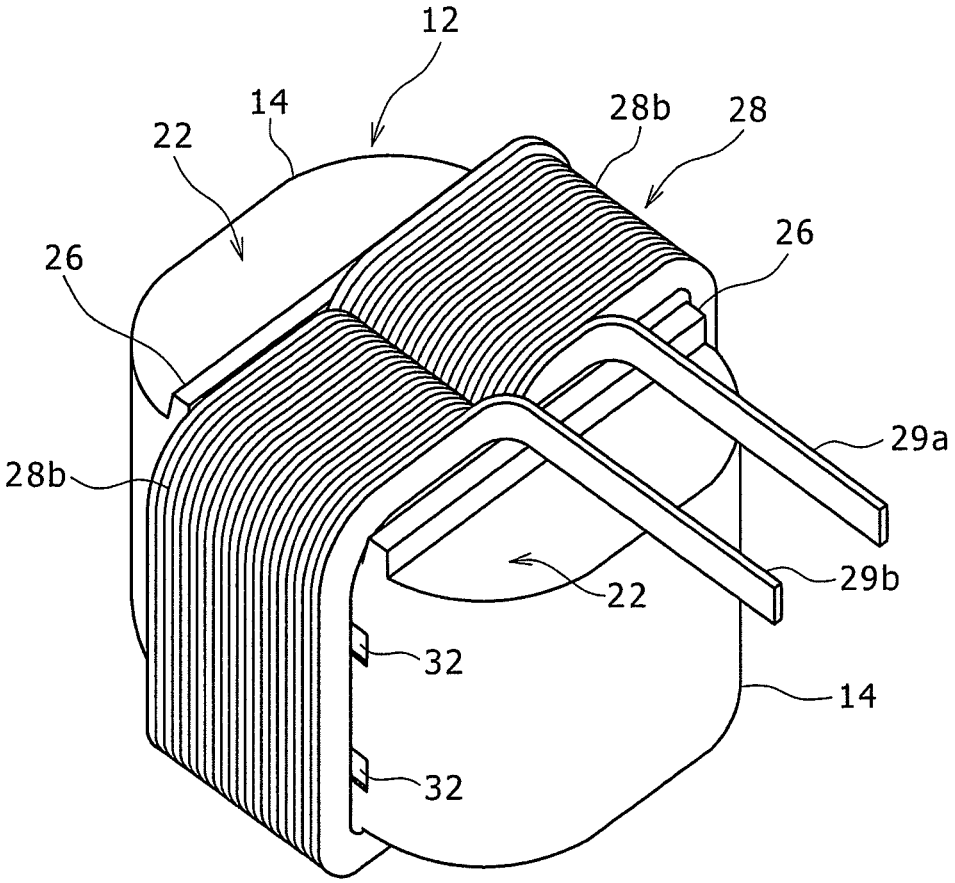
FIG. 5 is a perspective diagram showing a state in which the core member and the coil shown in FIG. 4 are assembled.

FIG. 5 is a perspective diagram showing a state where the core member 14 and the coil 28 shown in FIG. 4 are assembled. When the two core members 14 are connected by passing the leg parts 16 and 18 through the coil sections 28*a* and 28*b* as described above, the reactor core 12 in which two core members 14 are connected in a ring shape with a gap section therebetween, and the coil 28 which is placed around the leg parts 16 and 18 including the gap section in the reactor core 12, are assembled.

In this process, the cutout sections 30 of the end of the leg covering section 24 are connected to each other as described above, so that a window section 33 in communication with the gap section is formed. In addition, in this state, a slight gap is formed between the wall section 26 of the primary insert-molded resin part 22 of the core member 14 and the ends of the coil sections 28*a* and 28*b*. Because of this configuration, the melted thermoplastic resin which forms the secondary insert-molded resin part to be described later can flow into the inside of the coil sections 28*a* and 28*b*.

Figure 6:
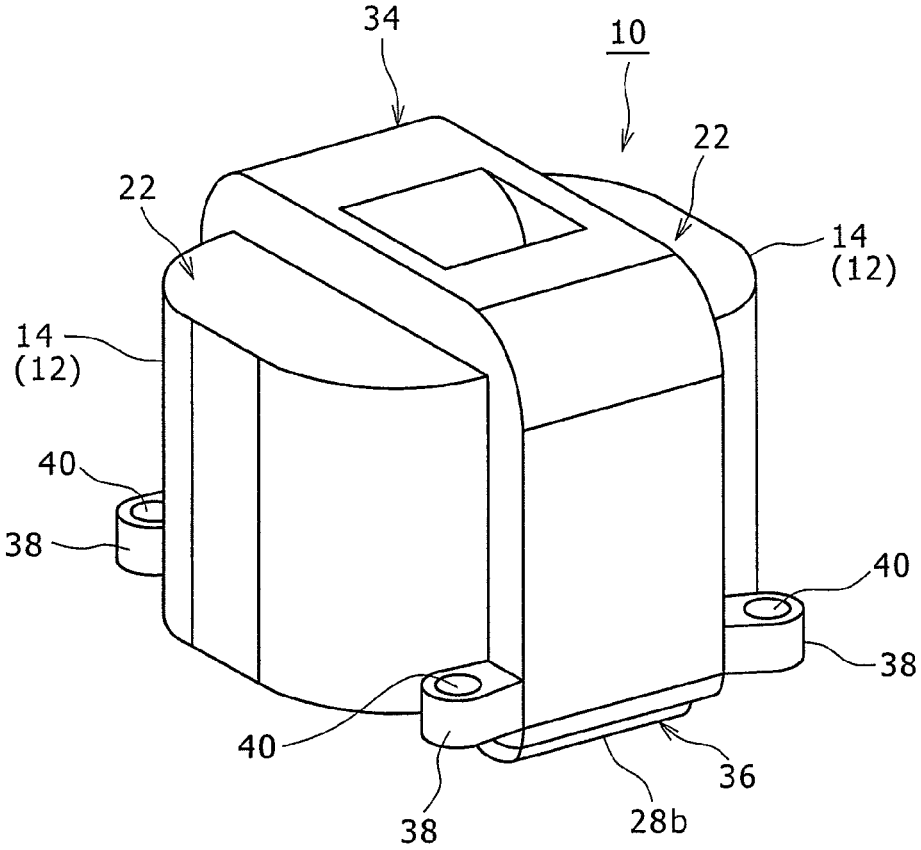
FIG. 6 is a perspective diagram showing a state in which a secondary insert-molded resin part is formed on the reactor core and the coil shown in FIG. 5.

FIG. 6 is a perspective diagram showing a state where the secondary insert-molded resin part 34 is formed in the reactor core 12 and the coil 28 shown in FIG. 5, to fix the coil 28 to the reactor core 12. In FIG. 6, the conductor ends 29*a* and 29*b* protruding and extending from the secondary insert-molded resin part 34 are not shown.

The reactor core 12 and the coil 28 assembled as shown in FIG. 5 are placed on another molding tool, and a thermoplastic resin such as, for example, a PPS resin is injection-molded, to form the secondary insert-molded resin part 34. The secondary insert-molded resin part 34 may be formed with the same thermoplastic resin material as the primary insert-molded resin part 22, or may be formed with a different thermoplastic resin material.

A plurality of attachment sections 38 for attaching the reactor 10 to a reactor attachment member by a bolt are integrally formed with the secondary insert-molded resin part 34 in a protruding manner. In the present embodiment, an example configuration is shown in which four attachment sections 38 are formed. In the attachment section 38, a bolt passing hole 40 is formed in a penetrating manner. By integrally molding the attachment section 38 with the secondary insert-molded resin part 34, it becomes not necessary to specially provide an attachment section made of a metal plate, resulting in reduction in the number of constituent components and reduction in cost. The attachment section may be integrally formed in advance on an exposed section of the primary insert-molded resin part 22 which is not covered with the secondary insert-molded resin part 34.

The secondary insert-molded resin part 34 is formed covering almost the entirety of the periphery of the coil sections 28*a* and 28*b* forming the coil 28. With this configuration, the two coil sections 28*a* and 28*b* of the coil 28 are firmly fixed on the reactor core 12 having a ring shape. In addition, the secondary insert-molded resin part 34 is formed covering a region up to an outside of the wall sections 26 of the primary insert-molded resin parts 22, and therefore, the two core members 14 are reliably fixed to each other in a connected state in a ring shape, due to an anchoring effect of the wall section 26.

When the secondary insert-molded resin part 34 is formed in this manner, the melted thermoplastic resin flows through the channel-shaped flow path 32 formed on the surface of the primary insert-molded resin part 22 to the window section 33, flows from the window section 33 to the gap section, and is filled in the gap section. In this manner, because the configuration facilitates flow of the melted thermoplastic resin along the flow path 32, and from the window section 33 into the gap section, secondary insert-molding with a low pressure and a low injection speed is enabled.

Figure 7:
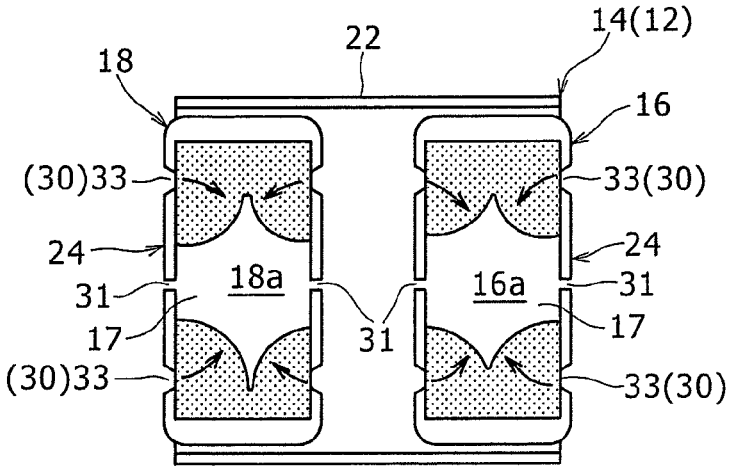
FIG. 7 is a diagram showing flow of a melted thermoplastic resin forming the secondary insert-molded resin part into a gap section between core members.

FIG. 7 is a diagram showing flow of the melted thermoplastic resin forming the secondary insert-molded resin part 34 into the gap section between the core members 14. As shown in FIG. 7, the melted thermoplastic resin flowing from the four window sections 33 into the gap section 17 between the end surfaces 16*a* and 18*a* of the leg parts flows in the direction of the arrow in a spreading manner. In this process, a gas draining passage 31 for allowing draining of the air and the gas generated from the melted thermoplastic resin from the gap section 17 to the outside is preferably formed. By forming such a gas draining passage 31, it becomes easier to fill the melted thermoplastic resin into the gap section 17 without a space, and the secondary insert-molding can be more stably executed.

The gas draining passage 31 is preferably positioned at a downstream side in relation to the flow and spreading direction of the melted thermoplastic resin in the gap section 17. More specifically, the gas draining passage 31 is preferably formed at an intermediate position of two window sections 33 formed on a long side section of the end of the leg covering section 24. By forming the gas draining passage 31 in such a position, it is possible to more reliably execute gas draining from the gap section 17.

Figure 8:
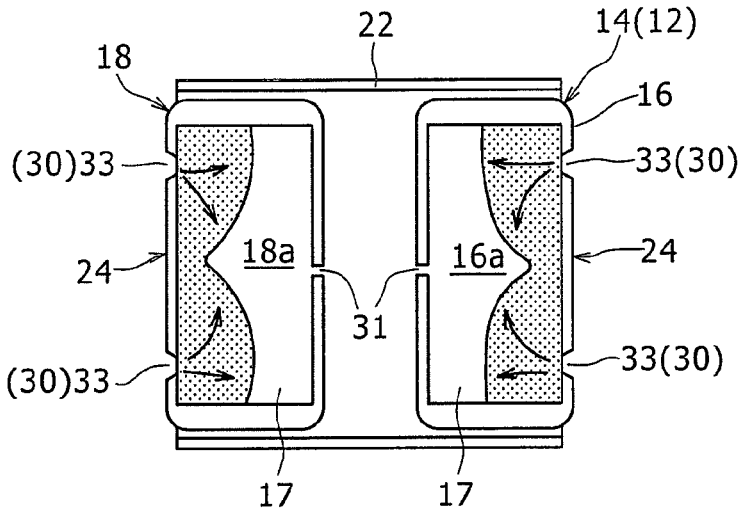
FIG. 8 is a diagram showing another flow of a melted thermoplastic resin forming the secondary insert-molded resin part into the gap section between core members.

FIG. 8 is a diagram showing an alternative configuration where two window sections 33 are provided for one gap section 17. In this case, because the window section 33 into which the melted thermoplastic resin flows is formed only on a long side section outside of the leg covering section 24, the gas draining passage 31 is preferably formed on a long side section at an inner side positioned downstream in relation to the direction of flow and spreading of the melted thermoplastic resin in the gap section 17. With such a configuration, it is possible to more reliably execute the gas draining from the gap section 17.

FIGS. 7 and 8 show example configurations where the window section 33 is provided near the corner section of the gap section 17 having an approximate rectangular shape, but the present invention is not limited to such a configuration, and it is only necessary for the window section 33 to be formed at a position where the thermoplastic resin flowing into the gap section 17 can easily uniformly flow. For example, the window section may be formed at the corner section of the gap section.

Figure 9:
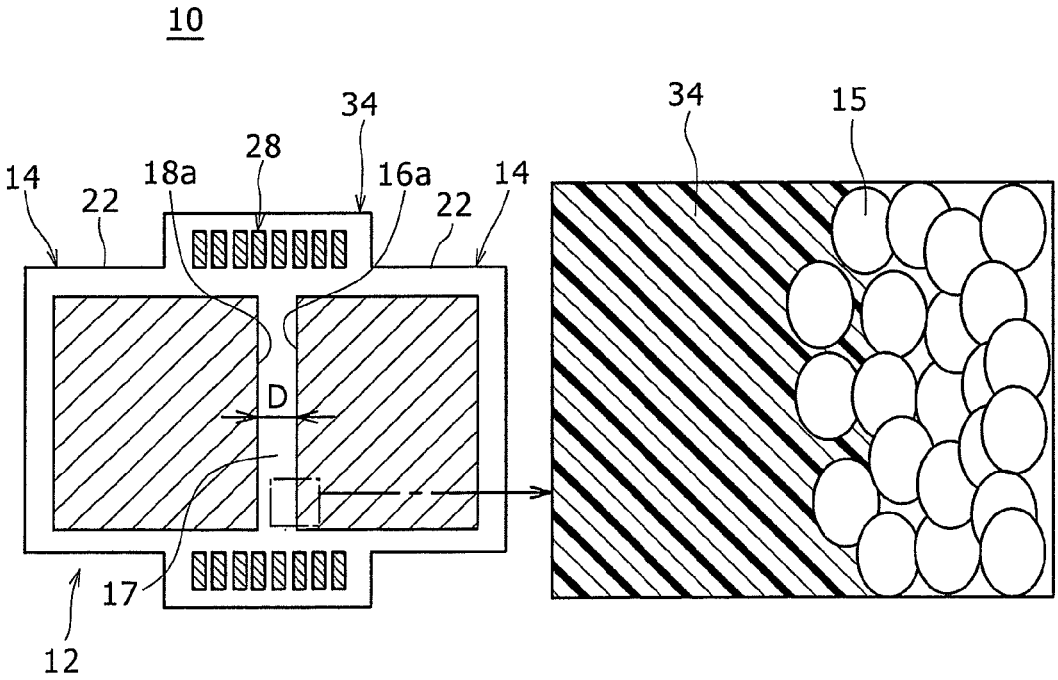
FIG. 9 is a partial enlarged cross sectional diagram of a gap section of a reactor in which a secondary insert-molded resin part is formed.

FIG. 9 is a partial enlarged cross sectional diagram of the gap section 17 of the reactor 10 in which the secondary insert-molded resin part 34 is formed. As shown in FIG. 9, the core member 14 is formed with a pressed powder core, and when the surfaces of the end surfaces 16*a* and 18*a* of the leg parts opposing the gap section 17 are microscopically viewed, a gap is formed between magnetic powder 15 existing on the end surfaces. With this configuration, during the secondary insert-molding, the melted thermoplastic resin flowing into the gap section 17 can be cured in a state where the thermoplastic resin has entered the gap between the magnetic powder 15, and the adhesion strength on the end surfaces 16*a* and 18*a* of the leg parts can be improved by the anchoring effect. Therefore, the two core members 14 are firmly adhered and fixed by a part of the secondary insert-molded resin part 34 in the gap section 17.

Figure 10:
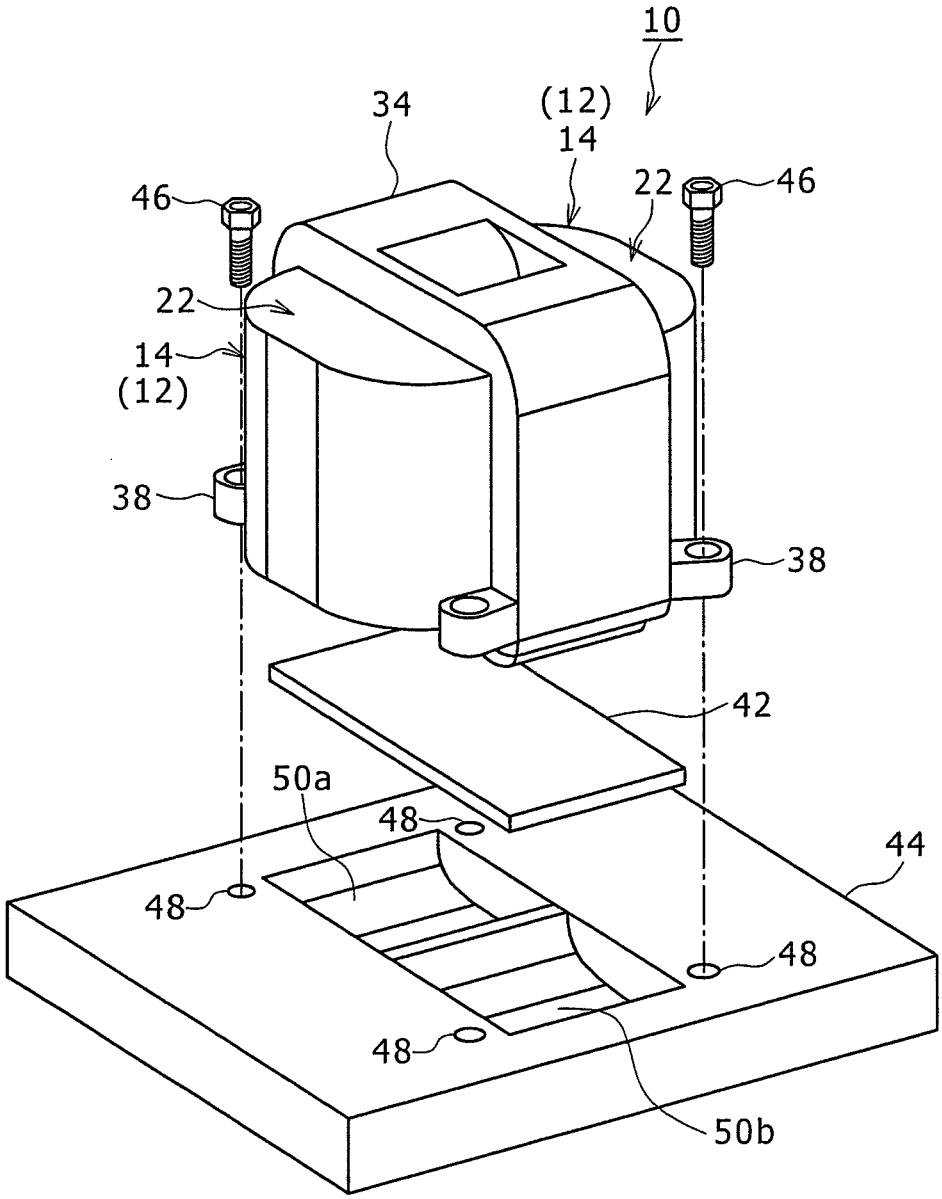
FIG. 10 is a detailed perspective diagram showing attachment of the reactor on a bottom plate of a metal casing via a heat dissipation sheet.

FIG. 10 is an exploded perspective view showing attachment of the reactor 10 on a bottom plate 44 of the metal casing with a heat dissipation sheet 42 between the reactor 10 and the bottom plate 44. As shown in FIG. 10, a bolt 46 is passed through the attachment section 38 of the secondary insert-molded resin part 34 and is tightened into a female threaded hole 48 formed on the reactor attachment member, more specifically, the bottom plate 44 of the metal casing made of, for example, an aluminum alloy, so that the reactor 10 manufactured and completed by forming the secondary insert-molded resin part 34 as described above is fixed on the bottom plate 44 of the metal casing with the heat dissipation sheet 42 sandwiched therebetween.

On the bottom plate 44 of the metal casing, attachment recesses 50*a* and 50*b* are formed, having a shape into which lower parts of the coil sections 28*a* and 28*b* of the coil 28 covered by the secondary insert-molded resin part 34 of the reactor 10 are fitted. With this configuration, the lower parts of the coil sections 28*a* and 28*b* can be closely contacted with the bottom plate 44 of the metal casing through the heat dissipation sheet 42, and as a result, a superior heat dissipation characteristic from the coil sections 28*a* and 28*b* to the bottom plate 44 of the metal casing can be ensured. In addition, because the heat dissipation sheet 42 also functions as an insulating sheet, the insulating characteristic between the coil sections 28*a* and 28*b* and the bottom plate 44 of the metal casing can also be improved.

Although not shown in FIG. 10, the bottom plate 44 of the metal casing forms a side wall of a cooling device to which cooling water is supplied in a circulating manner, or a cooling device is provided adjacent to the bottom plate 44 of the metal casing on the backside (that is, on a surface opposite to the attachment surface of the reactor 10), so that the bottom plate 44 of the metal casing is forcefully cooled.

In the above, a configuration is described in which the lower parts of the coil sections 28*a* and 28*b* of the coil 28 are covered with the secondary insert-molded resin part 34, but the present invention is not limited to such a configuration, and a configuration may be employed in which only the lower parts of the coil sections 28*a* and 28*b* are not covered with the secondary insert-molded resin part 34 and are exposed, and the coil sections 28*a* and 28*b* are in contact with the bottom plate 44 of the metal casing through the heat dissipation sheet 42. With such a configuration, the heat transfer characteristic from the coil 28 to the bottom plate 44 of the metal casing can be improved, and the cooling capability of the coil 28 can be improved.

In addition, in the above-described configuration, a thermoplastic resin having a higher heat transfer characteristic than the thermoplastic resin used for the primary insert-molded resin part 22 may be used for the thermoplastic resin of the secondary insert-molded resin part 34. In this case, for example, particles with high heat transfer characteristic such as, for example, silica, may be mixed in the thermoplastic resin for the secondary insert-molded resin part, to improve the heat transfer capability. With such a configuration, even if the entire outer periphery of the coil 28 is covered with the secondary insert-molded resin part 34, the heat transfer characteristic from the coil 28 to the outside can be made superior. In addition, by forming only the secondary insert-molded resin part 34 with a high heat transfer characteristic resin, an advantage can be obtained that an increase in the cost of the material can be suppressed.

Next, a method of manufacturing the reactor 10 having a structure described above will be described.

First, two core members 14 and the coil 28 including the coil sections 28*a* and 28*b* are prepared (refer to FIGS. 1 and 4).

Next, the primary insert-molded resin part 22 made of a thermoplastic resin is formed covering at least the outer peripheral surface of the core member 14 other than the adhesion surfaces of the core members.

Next, the two core members 14 are placed in an orientation in which the leg parts 16 and 18 oppose each other, the leg parts 16 and 18 are passed through the coil sections 28*a* and 28*b*, and the ends of the primary insert-molded resin parts 22 around the end surfaces 16*a* and 18*a* of the leg parts 16 and 18 are connected to form a ring-shaped reactor core (refer to FIGS. 3-5). In this process, the gap section 17 having a certain size D is formed between the opposing end surfaces 16*a* and 18*a* of the leg parts, and the window section 33 in communication with the gap section 17 is formed.

The secondary insert-molded resin part 34 made of a thermoplastic resin is then formed on the reactor core 12 in which the coil 28 is placed around the gap section 17, to fix the coil sections 28*a* and 28*b* of the coil 28 on the reactor core 12 and fix the core members 14 in the connected state (refer to FIG. 6). In this process, the melted thermoplastic resin for secondary insert-molding flows through the flow path 34 to the inside of the coil 28, flows through the window section 33 to the gap section 17, and fills the gap section 17, so that the end surfaces 16*a* and 18*a* of the leg parts are adhered and fixed to each other (refer to FIGS. 7 and 9).

The reactor 10 in which the secondary insert-molded resin part 34 is formed and the reactor core 12 and the coil 28 are fixed is taken out from the molding tool, and the manufacturing of the reactor is completed.

As described, in the reactor 10 of the present embodiment, the relative position of the opposing leg parts 16 and 18 is determined by the recess 25*a* and the projection 25*b* formed on the ends of the primary insert-molded resin parts 22, to define a certain size for the size D of the gap section 17. In addition, the melted thermoplastic resin for secondary insert-molding flows from the window section 33 to the gap section 17 and is cured, so that the end surfaces 16*a* and 18*a* of the leg parts of the core member 14 are adhered and fixed to each other, with the thermoplastic resin functioning as an adhesive. Therefore, it becomes no longer necessary to provide the non-magnetic gap plate as provided in the related art. Moreover, it becomes no longer necessary to provide the jig for maintaining the reactor and the heating and curing furnace used in the case where the thermosetting adhesive is used for adhesion and fixing of the core member 14.

Furthermore, with the secondary insert-molded resin part 34 made of the thermoplastic resin, the coil sections 28*a* and 28*b* can be fixed on the reactor core 12 and the two core members 14 can be connected and fixed in a firmly adhered state, and thus, the potting process of the thermosetting resin in a vacuum furnace and the heating and curing process in the heating furnace, as used in the related art, can be omitted, and the reactor manufacturing can be enabled at a high cycle (for example, about 40 seconds for insert-molding time required for one reactor).

In addition, in the reactor 10 of the present embodiment, an insulating distance between the coil 28 and the core member 14 is ensured by the primary insert-molded resin part 22 covering the periphery of the leg parts 16 and 18 of the core member 14 on which the coil 28 is attached. With such a configuration, the coil does not need to be assembled to the reactor core in a state where the coil is wound around an insulating resin bobbin, and the resin bobbin can be omitted.

Because of the above, according to the present embodiment, the reactor 10 can be easily manufactured in a short period of time, and the cost can be significantly reduced.

In the above, a preferred embodiment and alternative configurations of the present invention have been described. The reactor of the present invention is not, however, limited to the above-described configurations, and various modifications and improvements can be applied.

For example, in the above description, the primary insert-molded resin part 22 is formed covering the entire outer periphery of the core member 14 other than the end surfaces 16*a* and 18*a* of the leg parts. However, the primary insert-molded resin part 22 is not limited to such a configuration, and the primary insert-molding may be applied only in portions corresponding to the leg covering section 24 and the wall section 26, and the entirety or a part of the connecting section 20 of the core member 14 may be exposed. By exposing the core member in this manner, an advantage can be obtained that a heat dissipation characteristic from the core member is improved.

In addition, with regard to the secondary insert-molded resin part 34 also, a window section may be provided which exposes a part of the coil 28, so that the heat dissipation characteristic from the coil 28 to the outside is improved.

EXPLANATION OF REFERENCE NUMERALS

10 REACTOR; 12 REACTOR CORE; 14 CORE MEMBER; 16 FIRST LEG PART; 17 GAP SECTION; 18 SECOND LEG PART; 16*a*, 18*a* END SURFACE OF LEG PART; 20 CONNECTING SECTION; 22 PRIMARY INSERT-MOLDED RESIN PART; 24 LEG COVERING SECTION; 25*a* RECESS; 25*b* PROJECTION; 26 WALL SECTION; 28 COIL; 28*a*, 28*b* COIL SECTION; 29*a*, 29*b* CONDUCTOR END; 30 CUTOUT SECTION; 31 GAS DRAINING PASSAGE; 32 FLOW PATH; 33 WINDOW SECTION; 34 SECONDARY INSERT-MOLDED RESIN PART; 38 ATTACHMENT SECTION; 40 BOLT PASSING HOLE; 42 HEAT DISSIPATION SHEET; 44 REACTOR ATTACHMENT MEMBER OR BOTTOM PLATE OF METAL CASING; 46 BOLT; 48 FEMALE THREADED HOLE; 50*a*, 50*b* ATTACHMENT RECESS

The invention claimed is:

1. A reactor comprising:

a reactor core in which two U-shaped core members are connected in a ring shape with a gap section therebetween;

a primary insert-molded resin part which is fixed to cover at least an outer peripheral surface of a leg part of the core member other than an adhesion surface of the core member;

a coil which is placed around the gap section and the leg part of the core member; and a secondary insert-molded resin part which is made of a thermoplastic resin and which is insert-molded around the coil to fix the coil on the reactor core and fix the leg parts of the two core members in a connected state, wherein a positioning section which determines a relative position of opposed leg parts and a window section which allows a melted thermoplastic resin for forming the secondary insert-molded resin part to flow into the gap section are formed on ends of the primary insert-molded resin part connected to each other in a state in which the core members are placed connected in a ring shape, wherein the reactor is taken out from a molding tool after the secondary insert-molded resin part is formed in the molding tool, and wherein the secondary insert-molded resin part is formed covering almost the periphery of the coil and covering only a portion of the primary insert-molded resin part fixed on the reactor core.

2. The reactor according to claim 1, wherein a flow path for guiding the melted thermoplastic resin to the window section on an inner peripheral side of the coil is formed on a surface of the primary insert-molded resin part.

3. The reactor according to claim 2, wherein an end, on a side opposite to the window section, of a channel forming the flow path extends to outside of the coil.

4. The reactor according to claim 1, wherein a gas draining passage is formed on an end of the primary insert-molded resin part that is to be connected.

5. The reactor according to claim 4, wherein the gas draining passage is positioned at a downstream side in relation to a direction of flow and spreading of the melted thermoplastic resin flowing from the window section into the gap section.

6. The reactor according to claim 1, wherein the core member is made of a pressed powder core formed by pressure-molding magnetic powder, and the melted thermoplastic resin flowing into the gap section enters and is cured in a space between the magnetic powder forming an end surface of the leg part.

7. The reactor according to claim 1, wherein of two leg parts of one of the core members having the U shape, the positioning section having a recess shape is formed on the primary insert-molded resin part of one of the leg parts and the positioning section having a projected shape which is fitted with the recess-shaped positioning section is formed on the primary insert-molded resin part of the other leg part.

8. A method of manufacturing a reactor having a reactor core in which two U-shaped core members are connected in a ring shape with a gap section therebetween and a coil provided around the reactor core including the gap section, the method comprising:

preparing the two core members and the coil;

insert-molding a thermoplastic resin for each of the core members, to form a primary insert-molded resin part fixed to cover at least an outer peripheral surface of the core member other than an end surface of a leg part;

placing the core members connected in a ring shape in a state in which the leg part of the core member is passed through the coil, so that the ends of the primary insert-molded resin parts are connected to form a gap section of a certain size between opposed end surfaces of the leg parts and a window section in communication with the gap section;

insert-molding a thermoplastic resin around the coil in a molding tool to form a secondary insert-molded resin part which fixes the coil on the reactor core and fixes the leg parts of the two core members in a connected state, wherein a melted thermoplastic resin is allowed to flow through the window section into the gap section on an inner peripheral side of the coil to adhere the opposed end surfaces of the leg parts and wherein the secondary insert-molded resin part is formed covering the periphery of the coil and covering only a portion of the primary insert-molded resin part fixed on the reactor core, and taking out the reactor from the molding tool after the secondary insert-molded resin part has been formed.

9. The method of manufacturing a reactor according to claim 8, wherein the melted thermoplastic resin flowing through the window section into the gap section is guided along a flow path formed on a surface of the primary insert-molded resin part to the inner peripheral side of the coil, and flows to the window section.

10. The method of manufacturing a reactor according to claim 8, wherein when the melted thermoplastic resin is allowed to flow through the window section into the gap section and fill the gap section, the melted thermoplastic resin is filled while air or gas is drained through a gas draining passage formed on an end of the primary insert-molded resin part.

* * * * *